US006916234B2

(12) United States Patent
Suwabe

(10) Patent No.: US 6,916,234 B2
(45) Date of Patent: Jul. 12, 2005

(54) POLISHING MACHINE

(76) Inventor: Hitoshi Suwabe, 7-1, Ohgigaoka, Nonoichi, Ishikawa (JP), 921-8501

( * ) Notice: Subject to any disclaimer, the term of this patent is extended or adjusted under 35 U.S.C. 154(b) by 10 days.

(21) Appl. No.: 10/136,872

(22) Filed: May 1, 2002

(65) Prior Publication Data

US 2002/0173256 A1 Nov. 21, 2002

(30) Foreign Application Priority Data

May 2, 2001 (JP) ..... 2001-135348

(51) Int. Cl.[7] ..... B24B 29/00
(52) U.S. Cl. ..... 451/288; 451/285; 451/186
(58) Field of Search ..... 451/41, 285, 286, 451/287, 288, 397, 398

(56) References Cited

U.S. PATENT DOCUMENTS 5,584,751 A * 12/1996 Kobayashi et al. ..... 451/288
5,857,899 A * 1/1999 Volodarsky et al. ..... 451/72
6,019,868 A * 2/2000 Kimura et al. ..... 156/345.14
6,113,468 A * 9/2000 Natalicio ..... 451/41
6,132,298 A * 10/2000 Zuniga et al. ..... 451/288
6,146,259 A * 11/2000 Zuniga et al. ..... 451/398
6,435,949 B1 * 8/2002 Katsuoka et al. ..... 451/59
6,443,821 B1 * 9/2002 Kimura et al. ..... 348/231.6

FOREIGN PATENT DOCUMENTS

| | | |
|---|---|---|
| JP | 4-343658 | 11/1992 |
| JP | 2000-127024 | 5/2000 |
| JP | 2000-299301 | 10/2000 |
| JP | 2001-232553 | 8/2001 |

* cited by examiner

*Primary Examiner*—Joseph J. Hail, III
*Assistant Examiner*—Alvin J Grant
(74) *Attorney, Agent, or Firm*—Jordan and Hamburg LLP

(57) ABSTRACT

A polishing machine in which adverse influence caused by a surface condition of a retainer ring can be reduced with a simple structure. The polishing machine includes a rotatable polishing plate; a top ring including a holding plate for holding and pressing a wafer onto a polishing cloth of the polishing plate; an independently rotating retainer ring in which the holding plate is freely inserted; and a positioning member for correctly positioning the retainer ring on the polishing cloth while the retainer ring is rotated. The retainer ring includes a pressing member which presses the polishing cloth along an outer edge of the wafer to make the level of the polishing cloth pressed by the pressing member substantially equal to that of the polishing cloth pressed by the wafer.

24 Claims, 10 Drawing Sheets

POLISHING MACHINE

FIELD OF THE INVENTION

The present invention relates to a polishing machine, and more precisely relates to a polishing machine in which a wafer, held by a holding plate of a top ring, is pressed onto a polishing cloth of a polishing plate so as to polish a surface of the wafer.

BACKGROUND OF THE INVENTION

In a conventional polishing machine shown in FIG. 13, a wafer "W" is held on a holding face (a lower face) of a holding plate 100 of a rotatable top ring. The holding face is covered with a water-absorptive bucking member 106, e.g., a nonwoven fabric. A lower surface of the wafer "W" is pressed onto polishing cloth 104 adhered on a polishing plate 102. The top ring and the polishing plate 102 are rotated so as to polish the lower surface of the wafer "W". On the holding face of the holding plate 100, a template 108 is provided along an outer edge of the holding plate 100. The template 100 holds the wafer "W" at the right position on the holding face while polishing the wafer "W".

Slurry is supplied onto a polishing face (an upper face) of the polishing cloth 104, and the wafer "W" held by the holding plate 100 is pressed onto the polishing face with proper pressing force. In this state, the lower surface of the wafer "W" is polished by rotating the polishing plate 102.

However, as shown in FIG. 13, a depression 104*a*, which corresponds to the wafer "W", is formed in the polishing cloth 104 by the pressing force. The lower outer edge of the wafer "W" is abraded by an inner corner 104*b* of the depression 104*a*. By abrading the edge of the wafer "W", polishing accuracy of the edge of the wafer "W" must be low.

To reduce the bad influence caused by the depression 104*a*, an improved polishing machine was disclosed in U.S. Pat. No. 5,584,751. The improved machine will be explained with reference to FIG. 12.

In this improved polishing machine, a head section 200 comprises: a main body section 204 connected to a rotary shaft 201, which is vertically moved by elevating means (not shown), e.g., a cylinder unit, and rotated by rotating means (not shown), e.g., a motor; and a holding plate 210, which is provided in a concave part 206 of the main body part 204. An opening of the concave part 206 faces polishing cloth 205 adhered on a polishing plate (not shown). The holding plate 210 is suspended by an elastic sheet 208. Compressed air is supplied to and discharged from a space 211 formed between the elastic sheet 208 and inner faces of the concave part 206 by a compressor 215 via a pipe 214. With this structure, the holding plate 210 is vertically moved by adjusting air pressure in the space 211.

A retainer ring 212 is provided to a lower end of the main body part 204. The retainer ring 212 encloses the holding plate 210. The retainer ring 212 is suspended and connected to the main body part 204 by a donut-shaped elastic sheet 216. Compressed air is supplied to and discharged from a space 218 formed on the upper side of the elastic sheet 216 by a compressor 220 via a pipe 222. With this structure, the retainer ring 212 is vertically moved by adjusting air pressure in the space 218. An inner circumferential face of the retainer ring 212 slides on an outer circumferential face of the holding plate 210 while the retainer ring 212 is vertically moved. The vertical motion of the retainer ring 212 can be independently executed with respect to the holding plate 210.

A holding face of the holding plate 210 is covered with a water-absorptive bucking member 106, e.g., a nonwoven fabric. An inner circumferential face of the retainer ring 212 holds the wafer "W" at the right position on the holding face of the holding plate 210 while polishing the wafer "W".

In the polishing machine shown in FIG. 12, the head section 200 is downwardly moved to a prescribed position by the elevating means so as to move the wafer "W", which has been held on the bucking member 106 of the holding plate 210, close to the polishing cloth 205 of the polishing plate.

Then, the compressed air is supplied into the space 211 from the compressor 215 via the pipe 214 so as to downwardly move the holding plate 210 against the elasticity of the elastic sheet 208. With this action, the lower surface of the wafer "W" can be pressed onto the polishing cloth 205 with proper pressing force.

At that time, the compressed air is supplied into the space 218 by the compressor 220 via the pipe 222 so as to downwardly move the retainer ring 212 against the elasticity of the elastic sheet 216. With this action, the retainer ring 212 can be pressed onto the polishing cloth 205 with proper pressing force (load). The retainer ring 212 can be independently pressed with respect to the holding plate 210.

The head section 200 is rotated by the rotating means so as to polish the lower surface of the wafer "W" upon the application of the proper pressing force (load).

When the wafer "W" is polished, the pressing force (load) applied to the wafer "W" is different from that applied to the retainer ring 212. By pressing the retainer ring 212 enclosing the holding plate 210, the level of the polishing cloth 205 along the outer edge of holding plate 210, which is pressed by the retainer ring 212, can be made substantially equal to that of the polishing cloth 205 pressed by the wafer "W" as shown in FIG. 14. Therefore, the outer edge of the wafer "W" is not abraded by the inner corner 104*b* of the depression 104*a* (see FIG. 13), so that the polishing accuracy of the edge of the wafer "W" can be high.

Since the retainer ring 212 vertically slides on the outer circumferential face of the holding plate 210, the retainer ring 212 holds the wafer "W" at the right position on the holding face of the holding plate 210 while polishing the wafer "W". Therefore, no template 108 (see FIG. 13) provided along the outer edge of the holding plate 210 is required.

However, in the head section 200 shown in FIG. 12, the holding plate 210 and the retainer ring 212 are suspended, in the main body section 204, by the elastic sheets 208 and 216.

Therefore, the holding plate 210 is rotated together with the retainer ring 212, so positional relationship between the holding plate 210 and the retainer ring 212 are maintained during rotation.

With this structure, if any damage exists in a bottom face of the retainer ring 212, which presses the polishing cloth 205, a surface condition of the polishing cloth 205, which is badly influenced by the damage, badly influences flatness of the polished wafer "W".

Further, forming very fine projections in the bottom face of the retainer ring 212 is unavoidable due to machining accuracy, so the machining accuracy of the bottom face of the retainer ring 212 directly influences the polishing accuracy of the wafer "W".

If the holding plate 210 and the retainer ring 212 are independently rotated at different speeds, the detrimental influence caused by the surface condition of the bottom face of the retainer ring 212 can be very small.

However, the structure of the head section 200 for independently rotating the holding plate 210 and the retainer ring 212 at different speeds must be complex. Further, two motors for independently rotating are required, so that the whole structure of the polishing machine must be complex.

SUMMARY OF THE INVENTION

A first object of the present invention is to provide a polishing machine in which the detrimental influence caused by a surface condition of a retainer ring, which presses polishing cloth along an outer edge of a wafer, can be reduced with a simple structure.

A second object of the present invention is to provide a polishing machine in which the detrimental influence caused by the surface condition of the retainer ring can be reduced with the simple structure and in which pressing the polishing cloth by the retainer ring can be released if not required.

To achieve the first object, the polishing machine comprises:

a rotatable polishing plate on which polishing cloth is adhered;

a top ring connected to a rotary shaft and including a holding plate for holding and pressing a wafer onto the polishing cloth of said polishing plate so as to polish a surface of the wafer;

a retainer ring independently rotating with respect to said top ring and including a pressing member which encloses an outer edge of the wafer when the surface of the wafer held by the holding plate of said top ring freely inserted in said retainer ring is pressed onto the polishing cloth, said retainer ring pressing the polishing cloth so as to locate a surface of the polishing cloth pressed by the pressing member and another surface of the polishing cloth pressed by the wafer in the same plane; and a positioning member for correctly positioning said retainer ring on the polishing cloth of said polishing plate while the retainer ring is rotated with rotation of said polishing plate.

Another structure of the polishing machine comprises:

a rotatable polishing plate on which polishing cloth is adhered;

a top ring connected to a rotary shaft and including a holding plate for holding and pressing a wafer onto the polishing cloth of said polishing plate so as to polish a surface of the wafer;

a retainer including a pressing member which encloses an outer edge of the wafer when the surface of the wafer held by the holding plate of said top ring freely inserted in said retainer ring is pressed onto the polishing cloth, said retainer ring pressing the polishing cloth so as to locate a surface of the polishing cloth pressed by the pressing member and another surface of the polishing cloth pressed by the wafer in the same plane, and a cylindrical member, to which the pressing member is provided in which the top ring is inserted with a gap, and which is rotated on the polishing cloth of the polishing plate with rotation of the polishing plate; and a plurality of spherical bodies provided in the gap between an outer circumferential face of said top ring and an inner circumferential face of the cylindrical member, said spherical bodies point-contacting both circumferential faces so as to independently rotate said top ring and the cylindrical member without contacting each other.

The second object is achieved by a polishing machine comprising:

a rotatable polishing plate on which polishing cloth is adhered;

a top ring connected to a rotary shaft and holding and pressing a wafer onto the polishing cloth of said polishing plate so as to polish a surface of the wafer;

a retainer ring independently rotating with respect to said top ring and including a pressing member which encloses an outer edge of the wafer when the surface of the wafer held by the holding plate of said top ring freely inserted in said retainer ring is pressed onto the polishing cloth, said retainer ring pressing the polishing cloth so as to locate a surface of the polishing cloth pressed by the pressing member and another surface of the polishing cloth pressed by the wafer in the same plane; and means for moving the pressing member of said retainer ring toward and away from the polishing cloth while the surface of the wafer is pressed on the polishing cloth by said top ring; and a spacer maintaining a gap between said top ring and said retainer ring so as to rotate said top ring and said retainer ring without contacting each other.

In the present invention, the top ring and the retainer ring can be independently rotated, and the force for pressing the wafer held by the holding plate onto the polishing cloth and the force for pressing the retainer ring onto the polishing cloth along the outer edge of the wafer can be independently adjusted.

Further, the retainer ring is mounted on the polishing cloth of the polishing plate and rotated with the rotation of the polishing plate, the retainer ring and the holding plate can be independently rotated with different rotational speed.

Therefore, positional relationship between the holding plate and the retainer ring can be always changed while polishing the wafer, so that the detrimental and adverse influence caused by the surface condition of the bottom face of the retainer ring can be dispersed and significantly reduced.

Further, since the retainer ring is rotated by the rotation of the polishing plate, no rotating means, e.g., a motor, for rotating the retainer ring is required, so that the structure of the polishing machine can be simplified.

Especially, in the polishing machine having the spherical bodies provided between the inner circumferential face of the cylindrical member and the outer circumferential face of the top ring, the cylindrical member and the top ring can be independently rotated without contacting each other.

In the polishing machine for achieving the second object, the top ring and the retainer ring can be independently rotated, and the force for pressing the wafer held by the holding plate onto the polishing cloth and the force for pressing the retainer ring onto the polishing cloth along the outer edge of the wafer can be independently adjusted. The retainer ring and the holding plate can be independently rotated with different rotational speed, as well.

Further, the polishing machine has the means capable of moving the pressing member of the retainer ring toward and away from the polishing cloth while the surface of the wafer is pressed on the polishing cloth by the top ring, so that the retainer ring is capable of easily releasing the polishing cloth while polishing the wafer. Therefore, pressing the polishing cloth by the retainer ring can be easily released at any time if not required.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENTS

Preferred embodiments of the present invention will now be described in detail with reference to the accompanying drawings.

Figure 1:
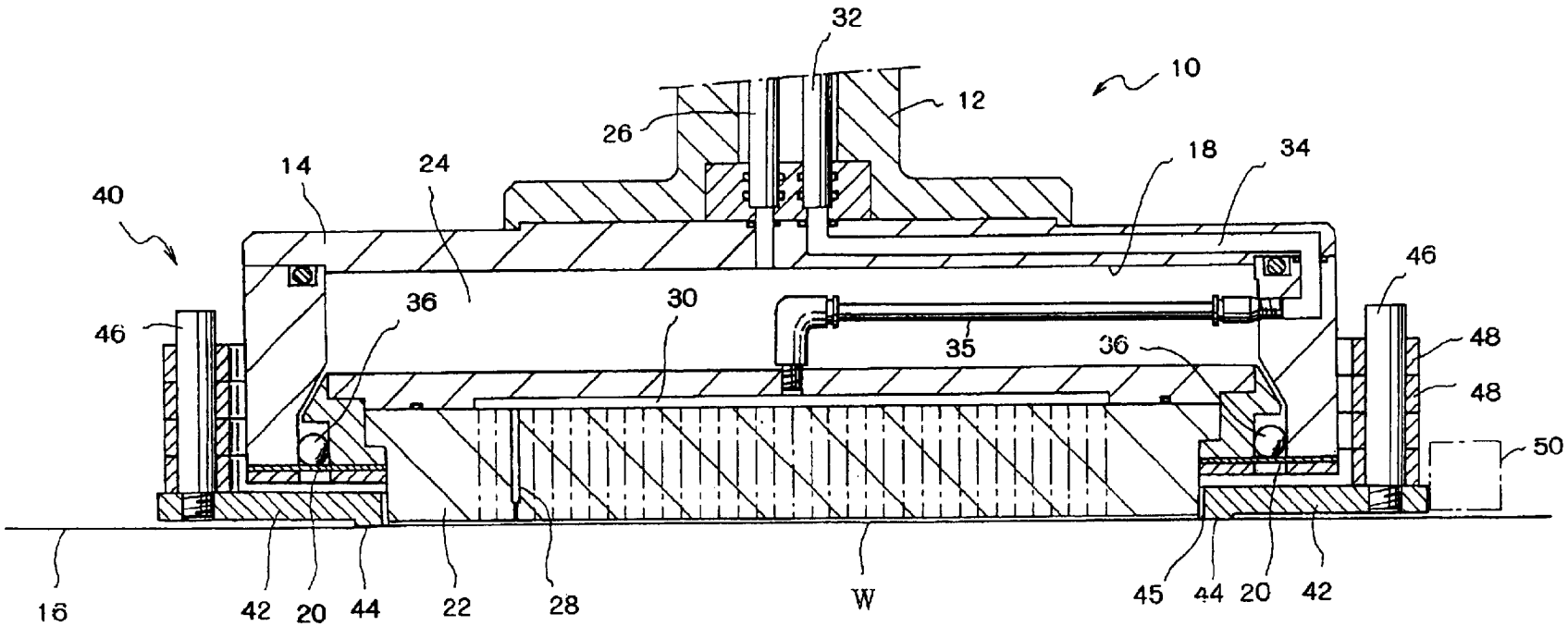
FIG. 1 is a sectional view of a head section of an embodiment of a polishing machine of the present invention.

In a polishing machine of a first embodiment of the present invention, a lower surface of a wafer, which has been held on a holding face of a holding plate of a top ring, is pressed onto and polished by polishing cloth of a rotating polishing plate. A head section having the top ring, etc. is shown in FIG. 1. FIG. 1 is a sectional view of the head section. The top ring 10 is provided to a lower end of a rotary shaft 12, which is vertically moved by proper elevating means (not shown), e.g., a cylinder unit, and rotated by proper rotating means (not shown), e.g., a motor. The top ring 10 includes: a main body section 14 fixed to the lower end of the rotary shaft 12; and a holding plate 22 provided in a concave part 18, which is formed in the main body section 14 and whose opening faces polishing cloth 16 adhered on an upper face of a polishing plate. The holding plate 22 is elastically suspended, by a donut-shaped elastic sheet 20, in the concave part 18, so that the holding plate 22 can be moved in the vertical direction.

In the main body section 14, a space 24 is formed between inner faces of the concave part 18 and the holding plate 22. Compressed air is supplied into and discharged from the space 24 by proper pressure means (not shown) via a pipe 26 provided in the rotary shaft 12. When air pressure in the space 24 exceeds elasticity of the elastic sheet 20, the holding plate 22 downwardly projects from the concave part 18. On the other hand, if the air pressure in the space 24 is smaller than the elasticity of the elastic sheet 20, the holding plate 22 is retracted in the concave part 18 by the elasticity.

Further, a plurality of through-holes 28 are formed in the holding plate 22, and their lower ends are opened in a holding face (a bottom face) of the holding plate 22. The through-holes 28 are mutually communicated by a communicating space 30. The communicating space 30 is communicated to proper vacuum means (not shown), e.g., a vacuum pump, via a pipe 32 provided in the rotary shaft 12, an air path 34 formed in the main body section 14 and a flexible pipe 35 provided in the space 24. With this structure, a wafer "W" can be sucked and held on the holding face of the holding plate 22 by actuating the vacuum means. When the vacuum means is stopped, negative pressure in the communicating space 30 disappears, so that the wafer "W" can be released from the holding face of the holding plate 22.

Note that the wafer "W" may be held on the holding plate 22 by the negative pressure and surface tension of water absorbed in a bucking member, e.g., unwoven cloth, adhered on the holding face of the holding plate 22. Namely, the holding plate 22 may directly or indirectly hold the wafer "W" on the holding face. When using the water surface tension, the wafer "W" may be held on the holding plate 22 by the water surface tension only while the wafer "W" is polished.

The top ring 10 is freely inserted in a retainer ring 40. The retainer ring 40 has a ring-shaped pressing member 42 which encloses the holding plate 22. A projected part 44, whose bottom face acts as a pressing face for pressing the polishing cloth 16, is downwardly projected along an inner edge of the pressing member 42.

Pins 46 are upwardly extended from the pressing member 42, and ring-shaped weights 48 are piled and correctly positioned by fitting with the pins 46. The weights 48 apply pressing force to the pressing member 42 so that the pressing face is capable of pressing the polishing cloth 16 with proper pressing force. The pressing force is defined on the basis of pressing force for pressing the wafer "W" onto the polishing cloth 16.

In the case of positioning the retainer ring 40 on the polishing face 16 by rollers 50 (see FIG. 3), preferably outer circumferential faces of the weights 48 are located on the inner side with respect to an outer circumferential face of the pressing member 42 so as to make the rollers 50 contact the outer circumferential face of the pressing member 42 without contacting the outer circumferential faces of the weights 48.

Figure 2:
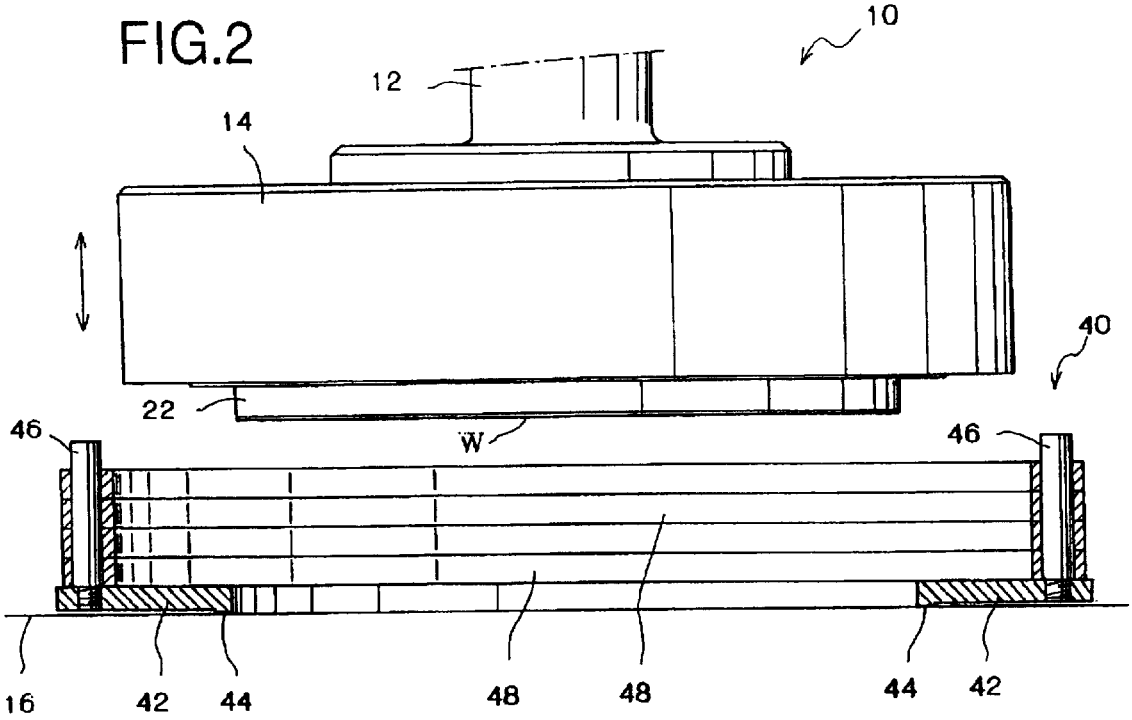
FIG. 2 is an explanation view of the head section shown in FIG. 1, in which a top ring is disassembled from a retainer ring.

In FIG. 1, the top ring 10, which is provided to the lower end of the rotary shaft 12, and the retainer ring 40, which is separated from the rotary shaft 12, are not integrated. Therefore, as shown in FIG. 2, the top ring 10 can be freely inserted into and pulled out from the retainer ring 40 mounted on the polishing cloth 16 adhered on the polishing plate.

The retainer ring 40 is correctly positioned so that the top ring 10 can be inserted into and pulled out without contacting the retainer ring 40.

Figure 3:
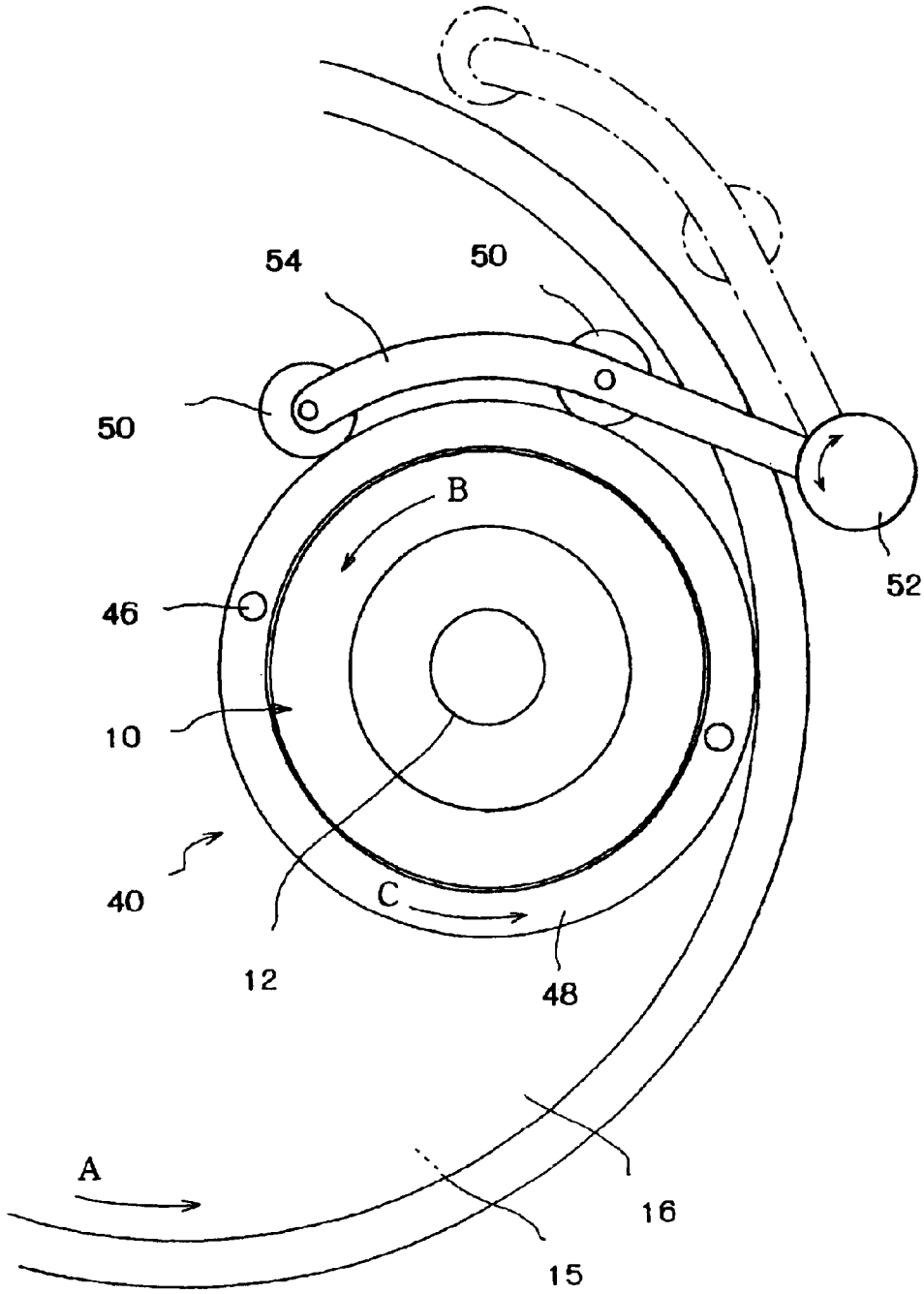
FIG. 3 is an explanation view, in which the head section shown in FIG. 1 is mounted on a polishing plate.

The rollers 50 are capable of correctly positioning the retainer ring 40 on the polishing cloth 16 of the polishing plate 15 as shown in FIG. 3. The rollers 50 are attached to an arm 54 which is extended from a rotary shaft 52. The rotary shaft 52 is rotatably attached to a base section of the polishing machine and located outside of the polishing plate 15. The rollers 50 contact the retainer ring 40, which is moved with the rotation "A" of the polishing plate 15, at two points, so that the retainer ring 40 can be correctly positioned at a prescribed position.

As shown in FIG. 1, the rollers 50 contact the outer circumferential face of the pressing member 42 of the retainer ring 40.

As shown in FIG. 2, the top ring 10 can be coaxially inserted into the retainer ring 40, which has been correctly positioned on the polishing plate 15, without contact and can be rotated in a direction "B" (see FIG. 3).

Since the retainer ring 40, which has been correctly positioned by the rollers 50, is mounted on the polishing plate 15 rotating in the direction "A", the retainer ring 40 is rotated in a direction "C" (see FIG. 3) with the rotation of the polishing plate 15 without reference to the rotation of the top ring 10. The pressing face 44 of the pressing member 42 presses the polishing cloth 16 along an outer edge of the wafer "W", which has been held and pressed onto the polishing cloth 16 by the top ring 10. With this action, level of the polishing cloth 16 pressed by the pressing face 44 of the pressing member 42 is made substantially equal to that of the polishing cloth 16 pressed by the lower surface of the wafer "W". Namely, the part of the polishing cloth 16 pressed by the pressing member 42 and the part of the polishing cloth 16 pressed by the wafer "W" can be substantially included in the same horizontal plane.

In FIG. 3, the top ring 10 and the retainer ring 40 are rotated in the same direction, but they both are independently rotated, so that their rotational speed can be easily respectively changed. By rotating them at different rotational speed, positional relationship between a prescribed position in the pressing face 44, which presses the polishing cloth 16, and a prescribed position in the wafer "W", which presses the polishing cloth 16, is continuously changed. By changing the relationship, even if there are very fine projections in the pressing face 44 of the pressing member 42, negative influences caused by the fine projections can be dispersed and significantly reduced, so that accuracy of polishing the wafer "W" can be improved.

Note that if positioning the retainer ring 40 is not required, the rollers 50 may be moved outside of the polishing plate 15 by rotating the shaft 52.

Figure 4:
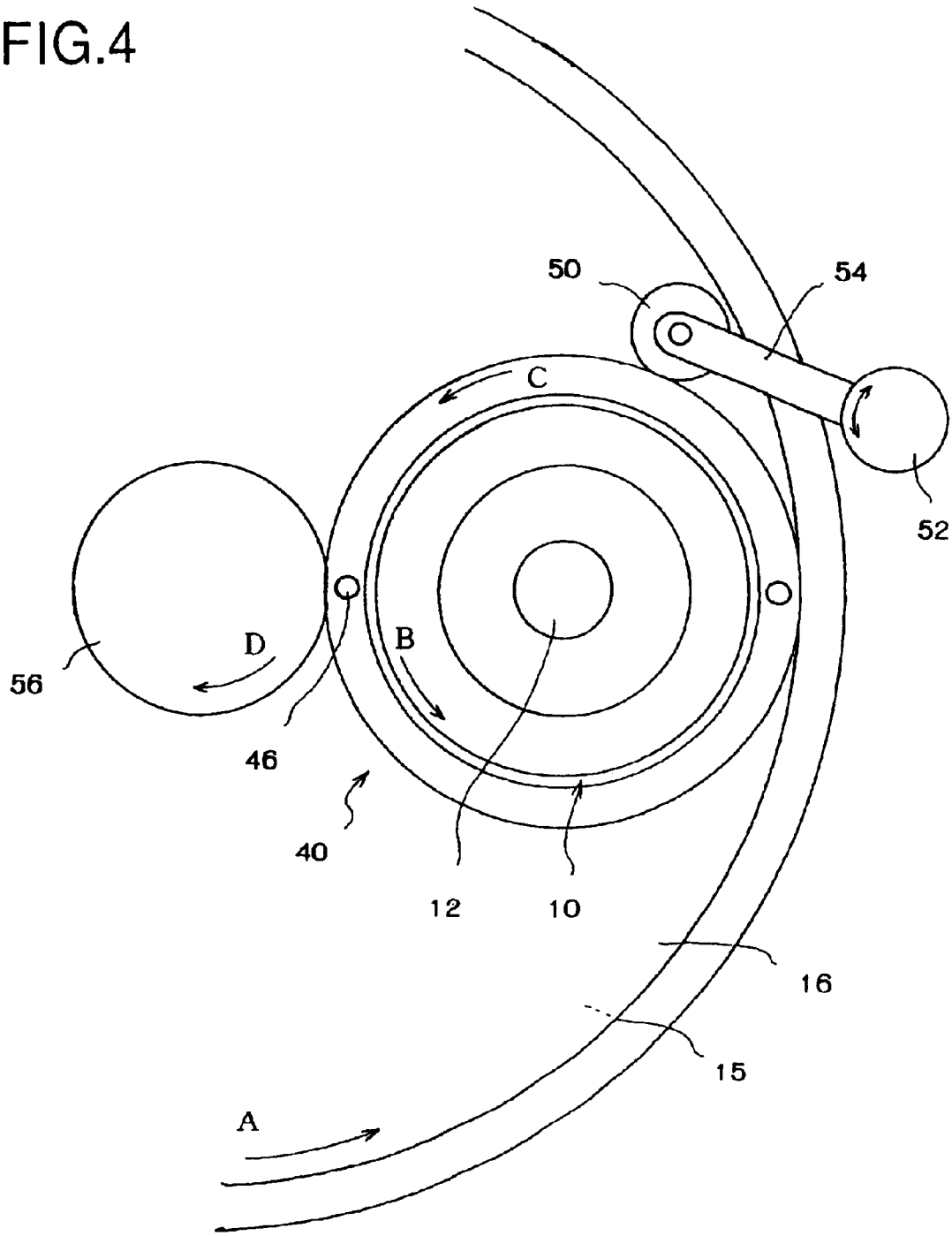
FIG. 4 is an explanation view showing another state, in which the head section shown in FIG. 1 is mounted on the polishing plate.

In FIG. 3, the retainer ring 40 is correctly positioned by two rollers 50; in FIG. 4, the retainer ring 40 is correctly positioned by a center roller 56 and one roller 50 attached to the arm 54 which is extended from the rotary shaft 52 rotatably attached to the base section and located outside of the polishing plate 15.

The center roller 56 and the roller 50 contact the outer circumferential face of the pressing member 42 of the retainer ring 40, which is moved with the rotation "A" of the polishing plate 15, at two points so as to correctly position the retainer ring 40 at a prescribed position. While positioning the retainer ring 40, the center roller 56 is rotated in the direction "D".

In the embodiments shown in FIGS. 1–4, the weights 48 are mounted on the pressing member 42, whose pressing face 44 presses the polishing cloth 16. On the other hand, a retainer ring 60 shown in FIG. 5 includes: the pressing member 42 having the pressing face 44 for pressing; and a cylindrical member 62 integrated with the pressing member 42.

Figure 5:
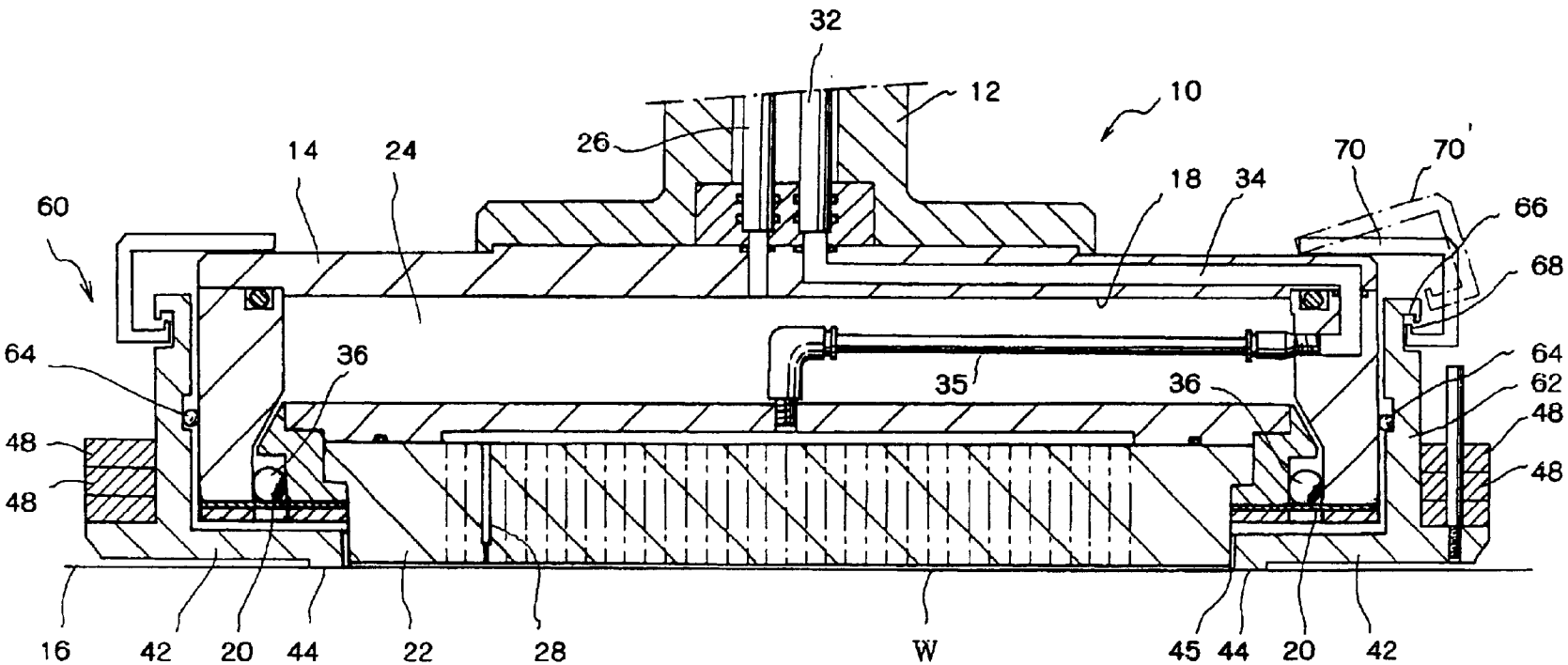
FIG. 5 is a sectional view of the head section of another example.

FIG. 5 is a sectional view of the head section of the polishing machine of a second embodiment. Pressing force of the pressing member 42, which presses the polishing cloth 16 can be adjusted by fitting the weights 48 on an outer circumferential face of the cylindrical member 62 of the retainer ring 60. The top ring 10 is inserted in the retainer ring 60, and there is formed a gap between an inner circumferential face of the cylindrical member 62 and an outer circumferential face of the top ring 10.

A plurality of spherical bodies 64 are provided between the inner circumferential face of the cylindrical member 62 and the outer circumferential face of the top ring 10. The spherical bodies 64 simultaneously contact both circumferential faces. With this structure, the top ring 10, which is rotated with the rotary shaft 12, and the retainer ring 60, which is mounted on the polishing cloth 16 of the polishing plate 15, can be rotated without contact. Preferably, the spherical bodies 64 are made of a corrosion-resistive metal, e.g., stainless steel, titanium or chemical-resistive resin, e.g., acryl, so as to prevent corrosion caused by slurry or moisture.

By providing the spherical bodies 64, the members for positioning the retainer ring 40, e.g., the rollers 50, etc. (see FIGS. 1–4), are not required in the second embodiment.

Note that the structure of the top ring 10 shown in FIG. 5 is equal to that of the top ring shown in FIG. 1, so the elements shown in FIG. 1 are assigned the same symbols and explanation will be omitted.

In the retainer ring 40 shown in FIGS. 1–4, the top ring 10 and the retainer ring 40 are not connected. Therefore, means for conveying the retainer ring 40 is required when the retainer ring 40 is mounted on and removed from the polishing cloth 16 of the polishing plate 15.

On the other hand, in the second embodiment shown in FIG. 5, means for engaging the top ring 10 with the retainer ring 60 is provided, so that they are mutually engaged when the lower surface of the wafer "W" held by the top ring 10 is upwardly moved away from the polishing cloth 16. Therefore, no means for conveying the retainer ring 60 to a prescribed position on the polishing cloth 16 is required.

In FIG. 5, the engaging means comprises: recesses 66 formed in the outer circumferential face of the cylindrical member 62 of the retainer ring 60; and hooks 70 provided to the top ring 10. The hooks 70 have projections 68, i.e., each hook 70 has one projection 68, each of which is capable of engaging with each recess 66.

In the present embodiment, a plurality of the engaging means are provided, and the recesses 66 and the projections 68 of the hooks 70 are disengaged while the lower surface of the wafer "W" held by the top ring 10 contacts the polishing cloth 16.

On the other hand, when the top ring 10 is upwardly moved and the lower surface of the wafer "W" is moved away from the polishing cloth 16, the projections 68 of the hooks 70 respectively engage with the recesses 66 so that the retainer ring 60 can be upwardly moved together with the top ring 10.

Note that the hook 70 may be moved to a position 70', which is shown by one-dot chain lines in FIG. 5, so as to securely disengage the projection 68 and the recess 68 while the lower surface of the wafer "W" contacts the polishing plate 16.

In the top ring 10 shown in FIGS. 1–5, the holding plate 22 is suspended by the donut-shaped elastic sheet 20 to allow the holding plate 22 to project from and retract into the concave part 18 of the main body section 14. To properly limit extension of the elastic sheet 20, the elastic sheet 20 is reinforced by a cloth-like reinforcing member.

However, deformation of the reinforcing member caused by external force parallel to warps and woofs is small, but deformation caused by external force diagonal to the warps and the woofs is great. Therefore, the degree of extension of the elastic sheet 20 is also varied by the direction of the force applied to the elastic sheet 20.

Since the holding plate 22 is suspended by the elastic sheet 20, whose degree of extension is varied by the direction of the force applied thereto, the movement of the holding plate 22 is varied by external force applied while rotating. If a gravity center of the wafer "W" is displaced from a rotational center thereof while the wafer "W" held by the holding plate 22 is rotated and polished with the pressing force, the outer edge of the wafer "W" is diagonally abraded.

In the top ring 10 shown in the embodiments of FIG. 1 or 5, a plurality of spherical bodies 36 are provided between the outer circumferential face of the holding plate 22 and the inner circumferential face of the concave part 18 of the main body section 14, and they simultaneously contact both circumferential faces. With this structure, the gravity center and the rotational center of the wafer "W" can be in correspondence with one another while polishing the wafer "W".

In the head section shown in FIG. 1, the movement of the holding plate 22 in the radial direction of the concave part 18 of the main body section 14 can be prevented by the spherical bodies 36. Therefore, the gap between the outer circumferential face of the holding plate 22 and the inner circumferential face of the retainer ring 40 can be made shorter.

The spherical bodies 36 are provided on the inner side of the elastic sheet 20, so that they can be separated from the slurry supplied onto the polishing cloth 16. Since the spherical bodies 36, which contact each other, simultaneously contact the outer circumferential face of the holding plate 22 and the inner circumferential face of the concave part 18 of the main body section 14, the movement of the holding plate 22 in the radial direction can be securely prevented, so that the holding plate 22 can be smoothly projected from and retracted into the concave part 18 of the main body section 14.

Preferably, the spherical bodies 36 are made of a corrosion-resistive metal, e.g., stainless steel, titanium or chemical-resistive resin, e.g., acryl, so as to prevent corrosion caused by moisture in the space 24.

Figure 6A:
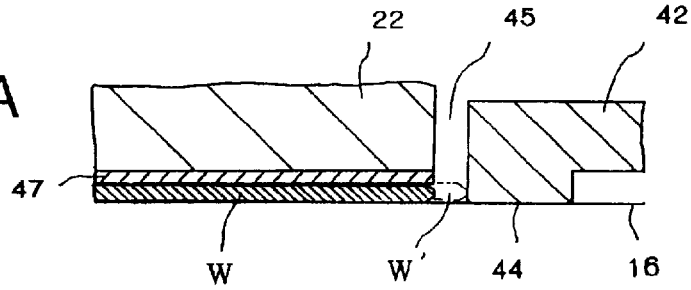
FIGS. 6A and 6B are partial sectional views showing states of polishing a wafer by the polishing machine shown in FIGS. 1–5.
Figure 6B:
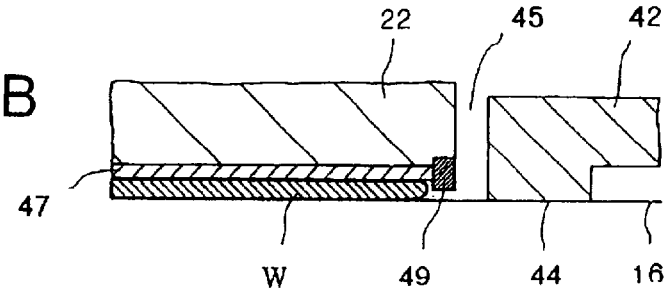

In the top ring 10 shown in FIGS. 1–5, the holding plate 22 and the pressing member 42 of the retainer ring 40 or 60 are independently rotated, so that a gap 45 is formed between the outer circumferential face of the holding plate 22 and the inner circumferential face of the pressing member 42 (see FIGS. 6A and 6B). If the gap 45 is made narrower, a part of the polishing cloth 16 pressed by the pressing face 44 of the pressing member 42 can be close to a part of the polishing cloth 16 pressed by the wafer "W".

Since the holding plate 22 and the pressing member 42 are independently rotated, it is impossible to make the gap 45 zero. If vacuum suction is stopped while polishing the wafer "W", the wafer "W" is held on the holding face of the holding plate 22 only by surface tension of water absorbed in the bucking member 47 (see FIG. 6A). Therefore, the wafer "W" is moved to a position "W'" by horizontal force so that the outer edge of the wafer "W" collides with the inner circumferential face of the pressing member 42 as shown in FIG. 6A.

Preferably, the inner circumferential face of the pressing member 42 is made of or coated with a ceramic or resin so as to prevent damage caused by the collision.

In FIG. 6B, the wafer "W" is held in a template 49, which is provided along the outer edge of the holding plate 22. With this structure, the wafer "W" is not moved on the bucking member 47 even if the wafer "W" is held on the holding face of the holding plate 22 only by the water surface tension. Therefore, the inner circumferential face of the pressing member need not be made of or coated with a ceramic or resin.

Further, if the wafer "W" is held on the holding face of the holding plate 22 by the water surface tension and the vacuum suction while polishing the wafer "W", the template 49 is not required.

In the case of adhering the wafer "W" on a lower face of a ceramic carrier plate and sucking an upper face of the carrier plate on the lower face of the holding plate 22 while polishing the wafer "W", no template 49 is not required as well as the example shown in FIG. 6B.

In the embodiments shown in FIGS. 1–6B, the positional relationship between a prescribed position of the wafer "W" and a prescribed position of the retainer ring 40 or 60 are varied while polishing the wafer "W", so that the detrimental influence caused by the surface condition of the pressing face 44 of the retainer ring 40 or 60 can be dispersed and much reduced. Namely, the accuracy of polishing the wafer "W" can be improved.

Since the retainer ring 40 or 60 is rotated by the rotation of the polishing plate 15, means for rotating the retainer ring 40 or 60, e.g., a motor, is not required, so that the structure of the polishing machine can be simplified.

In the embodiments shown in FIGS. 1–6B, even if pressing force is not applied to the polishing cloth 16 through the retainer ring 40 or 60, the polishing cloth 16 is pressed by the retainer ring 40 or 60. By continuously pressing the polishing cloth 16 by virtue of the weight of the retainer ring 40 or 60, the polishing cloth 16 is damaged and the polishing accuracy is negatively influenced.

Figure 7:
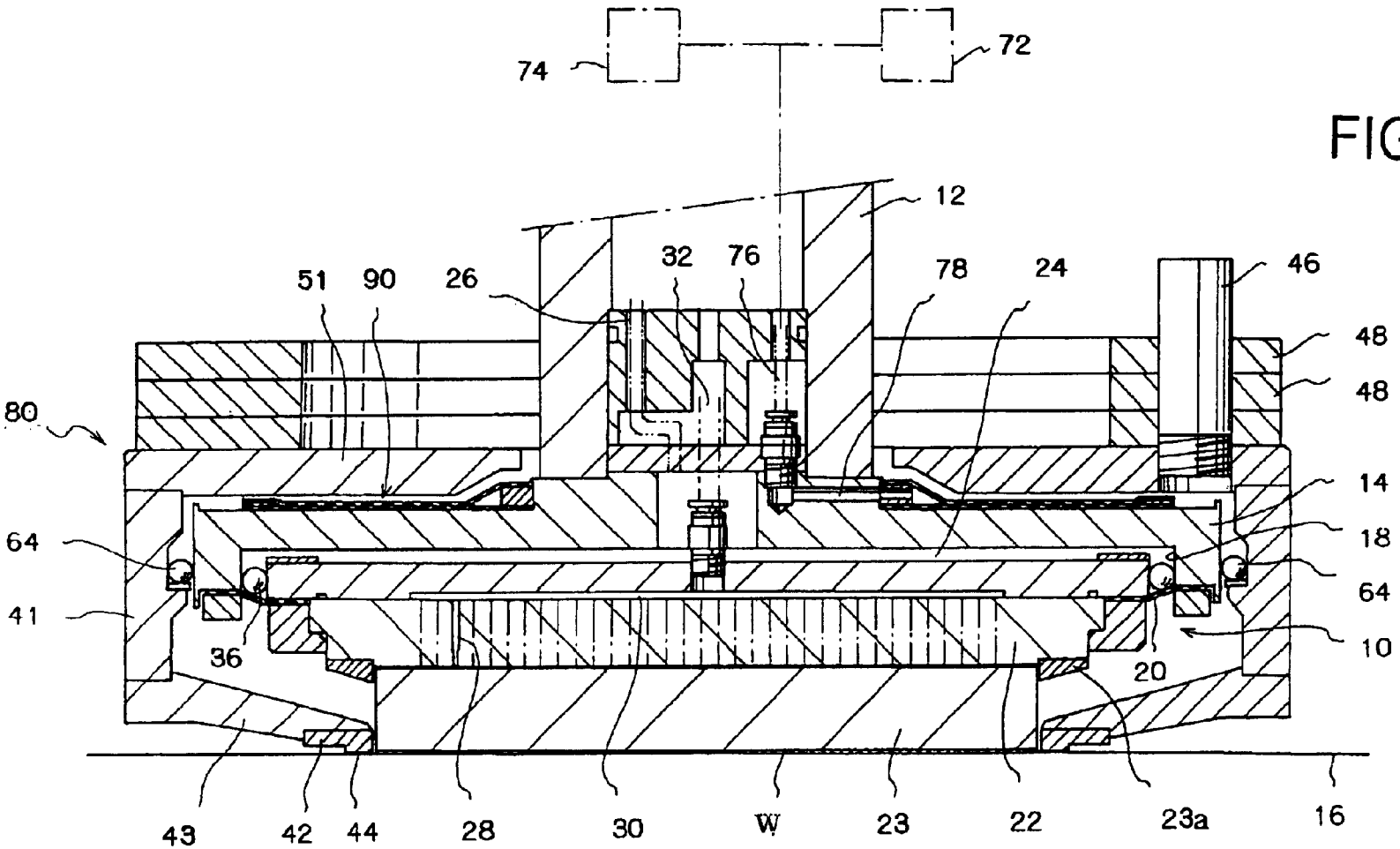
FIG. 7 a sectional view of the head section of other example of a polishing machine in accordance with the invention.

A third embodiment shown in FIG. 7 solves the problem. When a pressing force is not applied to the polishing cloth 16 through the retainer ring 80, pressing the polishing cloth 16 by the retainer ring 80 can be easily released. FIG. 7 is a sectional view of the head section of the polishing machine of the third embodiment.

In the head section shown in FIG. 7, the top ring 10 is provided to the lower end of the rotary shaft 12, which is vertically moved by the proper elevating means (not shown), e.g., a cylinder unit, and rotated by the proper rotating means (not shown), e.g., a motor. The top ring 10 includes: the main body section 14 fixed to the lower end of the rotary shaft 12; and the holding plate 22 provided in the concave part 18, which is formed in the main body section 14 and whose opening faces the polishing cloth 16 adhered on the upper face of a polishing plate. The holding plate 22 is elastically suspended, by the donut-shaped elastic sheet 20, in the concave part 18, so that the holding plate 22 can be moved in the vertical direction.

In the main body section 14, the space 24 is formed between the inner faces of the concave part 18 and the holding plate 22. Compressed air is supplied into and discharged from the space 24 by the proper pressure means (not shown) via the pipe 26 provided in the rotary shaft 12. When air pressure in the space 24 exceeds the elasticity of the elastic sheet 20, the holding plate 22 downwardly projected from the concave part 18. On the other hand, if the air pressure in the space 24 is smaller than the elasticity of the elastic sheet 20, the holding plate 22 is retracted in the concave part 18 by the elasticity of the elastic sheet 20.

A ceramic carrier plate 23 is held by the holding plate 22. The wafer "W" is adhered on a lower face of the carrier plate 23 by an adhesive or water surface tension. Namely, the holding face of the holding plate 22 indirectly holds the wafer "W" with the carrier plate 23.

A plurality of the through-holes 28 are formed in the holding plate 22, and their lower ends are opened in the holding face of the holding plate 22. The through-holes 28 are mutually communicated by the communicating space 30. The communicating space 30 is communicated to the proper vacuum means (not shown), e.g., a vacuum pump, via the pipe 32 provided in the rotary shaft 12. With this structure, the carrier plate 23 holding the wafer "W" can be sucked and held on the holding face of the holding plate 22 by actuating the vacuum means. When the vacuum means is stopped, negative pressure in the communicating space 30 disappears so that the carrier plate 23 can be released from the holding face of the holding plate 22.

A ring-shaped member 23*a,* whose sectional shape is a triangle, encloses the holding face of the holding plate 22. By the ring-shaped member 23*a,* even if horizontal force is applied to the carrier plate 23 while polishing the wafer "W" without sucking the carrier plate 23 by the vacuum pump, the carrier plate 23 can be held on the holding face of the holding plate 22.

In the top ring 10 shown in FIG. 7, the holding plate 22 is suspended by the donut-shaped elastic sheet 20 to allow the holding plate 22 to project from and retract into the concave part 18 of the main body section 14. To properly limit extension of the elastic sheet 20, the elastic sheet 20 is reinforced by the cloth-like reinforcing member.

However, deformation of the reinforcing member caused by external force parallel to warps and woofs is small, but deformation caused by external force diagonal to the warps and the woofs is great. Therefore, the degree of extension of the elastic sheet 20 is also varied by the direction of the force applied to the elastic sheet 20.

Since the holding plate 22 is suspended by the elastic sheet 20, whose degree of extension is varied by the direction of the force applied thereto, the movement of the holding plate 22 is varied by external force applied while rotating. If the gravity center of the wafer "W" is displaced from the rotational center thereof while the wafer "W" held by the holding plate 22 is rotated and polished with the pressing force, the outer edge of the wafer "W" is diagonally abraded.

In the top ring 10 shown in FIG. 7, a plurality of the spherical bodies 36 are provided between the outer circumferential face of the holding plate 22 and the inner circumferential face of the concave part 18 of the main body section 14, and they simultaneously contact both circumferential faces. With this structure, the gravity center and the rotational center of the wafer "W" can be in correspondence with one another while polishing the wafer "W".

The movement of the holding plate 22 in the radial direction of the concave part 18 of the main body section 14 can be prevented by the spherical bodies 36. Therefore, the gap between the outer circumferential face of the holding plate 22 and the inner circumferential face of the retainer ring 80 can be made shorter.

The spherical bodies 36 are provided on the inner side of the elastic sheet 20 so that they can be separated from the slurry supplied onto the polishing cloth 16. Since the spherical bodies 36, which contact each other, simultaneously contact the outer circumferential face of the holding plate 22 and the inner circumferential face of the concave part 18 of the main body section 14, the movement of the holding plate 22 in the radial direction can be securely prevented, so that the holding plate 22 can be smoothly projected from and retracted into the concave part 18 of the main body section 14.

Preferably, the spherical bodies 36 are made of a corrosion-resistive metal, e.g., stainless steel, titanium or chemical-resistive resin, e.g., acryl, so as to prevent corrosion caused by moisture in the space 24.

The top ring 10 is inserted in the retainer ring 80. The top ring 80 includes: the cylindrical member 41 in which the main body section 14 and the holding plate 22 of the top ring 10 are inserted; an extended member 43 extended from a lower end of the cylindrical member 41 toward the carrier plate 23; and the ring-shaped pressing member 42 provided to an inner edge of the extended member 43. The pressing member 42 encloses the carrier plate 23. The projected part 44 or the pressing face for pressing the polishing cloth 16 is downwardly projected along the inner edge of the pressing member 42.

An extended section 51 is inwardly extended from an upper end of the cylindrical member 41. The pins 46 are upwardly extended from the extended section 51, and the ring-shaped weights 48 are piled and correctly positioned by fitting with the pins 46. The weights 48 apply pressing force to the pressing member 42 so that the pressing face 44 is capable of pressing the polishing cloth 16 with proper pressing force. The pressing force is defined on the basis of the pressing force for pressing the wafer "W" onto the polishing cloth 16. The top ring 10 is inserted in the cylindrical member 41 of the retainer ring 80, and there is formed a gap between an inner circumferential face of the cylindrical member 41 and the outer circumferential face of the top ring 10.

A plurality of the spherical bodies 64 are provided between the inner circumferential face of the cylindrical member 41 and the outer circumferential face of the top ring 10. The spherical bodies 64 simultaneously contact both circumferential faces. With this structure, the top ring 10, which is rotated with the rotary shaft 12, and the retainer ring 80, which is mounted on the polishing cloth 16 of the polishing plate 15, can be rotated without contact. Preferably, the spherical bodies 64 are made of a corrosion-resistive metal, e.g., stainless steel, titanium or chemical-resistive resin, e.g., acryl, so as to prevent corrosion caused by slurry or moisture.

The polishing machine shown in FIG. 7 has means for moving the pressing member 42 of the retainer ring 80 toward and away from the polishing cloth 16 while the lower surface of the wafer "W" is pressed on the polishing cloth 16 by the top ring 10.

The moving means includes: the extended section 51 extended from the upper end of the cylindrical member 41 of the retainer ring 80 to an upper face of the top ring 10; a balloon member 90 provided between the extended section 51 and the upper face of the top ring 10; and a compressor 72 and a vacuum pump 74, which act as the fluid control means for supplying a fluid (compressed air) into and discharging the fluid from the balloon member 90 via a pipe 76 provided in the rotary shaft 76 and fluid paths 78 formed in the main body section 14.

Figure 8:
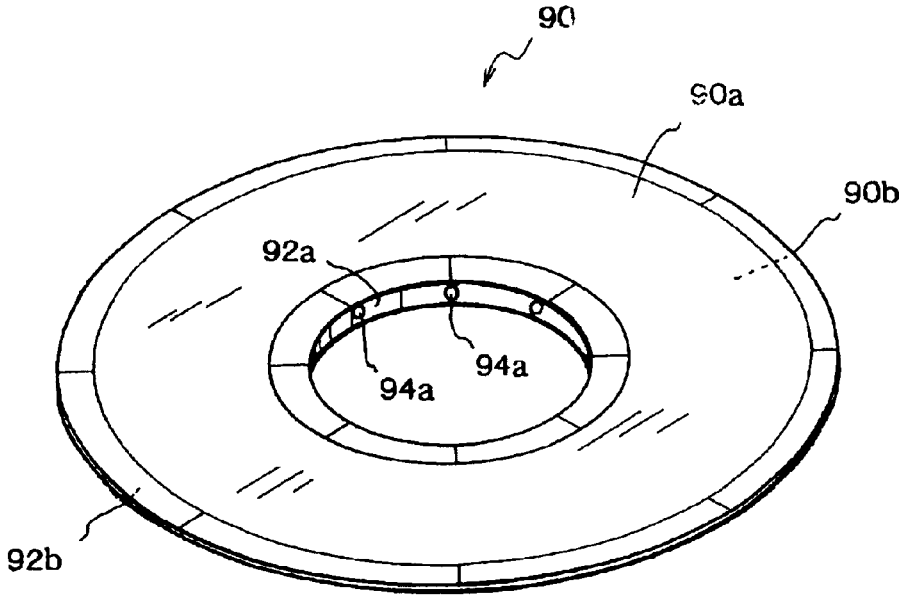
FIG. 8 is a perspective view of a balloon member included in the head section shown in FIG. 7.

As shown in FIG. 8, the balloon member 90 is constituted by two donut-shaped elastic sheets 90*a* and 90*b,* which are made of, for example, rubber. Inner edges of the elastic sheets 90*a* and 90*b* are fixed to an inner frame 92*a;* outer edges thereof are fixed to an outer frame 92*b*. A plurality of air inlets 94*a* are opened in an inner circumferential face of the inner frame 92*a*. The air inlets 94*a* are respectively communicated to the paths 78 (see FIG. 7).

Figure 9:
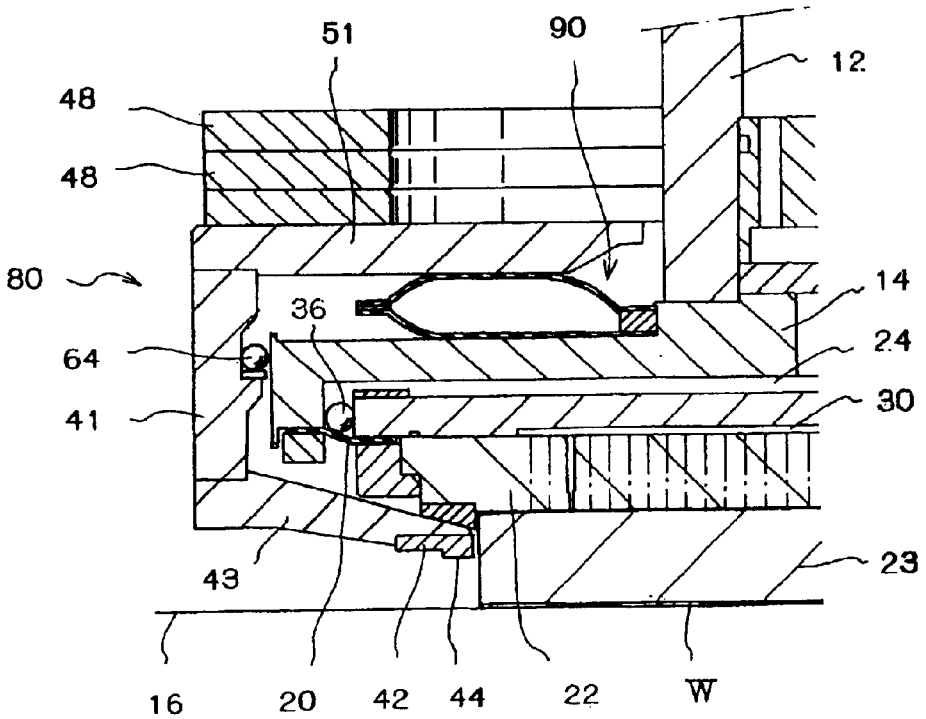
FIG. 9 is a partial sectional view of the balloon member expanded.

The balloon member 90 shown in FIG. 8 is provided between the extended section 51 extended from the cylindrical section 41 toward the upper face of the top ring 10 and the upper face of the top ring 10. When the compressor 72 supplies compressed air into the balloon member 90 via the pipe 76 provided in the rotary shaft 12 and the paths 78 formed in the main body section 14, the balloon member 90 is expanded as shown in FIG. 9, then the balloon member 90 upwardly moves the extended section 51 against the pressing force of the retainer ring 80, which is given by the weights 48, so that the pressing face 44 of the pressing member 42 can be moved away from the polishing cloth 16.

With this structure, pressing the polishing cloth 16 by the pressing member 42 of the retainer ring 80 can be easily stopped while polishing the wafer "W". Therefore, the retainer ring 80 can release the polishing cloth 16 any time if pressing the polishing cloth 16 is not required.

Since the extended section 51 is extended from the upper end of the cylindrical section 41 of the retainer ring 80 toward the upper face of the top ring 10, the retainer ring 80 is vertically moved with the vertical movement of the top ring 10.

To press the polishing cloth 16 by the retainer ring 80, the compressed air in the balloon member 90 is discharged. By discharging the air, the balloon member 90 contracts so that the extended section 51 is downwardly moved by the pressing force of the retainer ring 80, then the polishing cloth 16 can be pressed by the pressing face 44 of the pressing member 42 of the retainer ring 80.

While the balloon member 90 is expanded and the pressing face 44 of the pressing member 42 is separated from the polishing cloth 16, the retainer ring 80 and the top ring 10 are rotated, at the same speed, with the balloon member 90.

When the balloon member 90 is contracted to press the polishing cloth 16 by the pressing face 44 of the pressing member 42, the retainer ring 80 is mounted onto the polishing cloth 16 and independently rotated with respect to the top ring 10.

Therefore, preferably, the vacuum pump 74 is driven so as to discharge the air from the balloon member 90 in a short time and form a gap between the balloon member 90 and the extended section 51.

Figure 10:
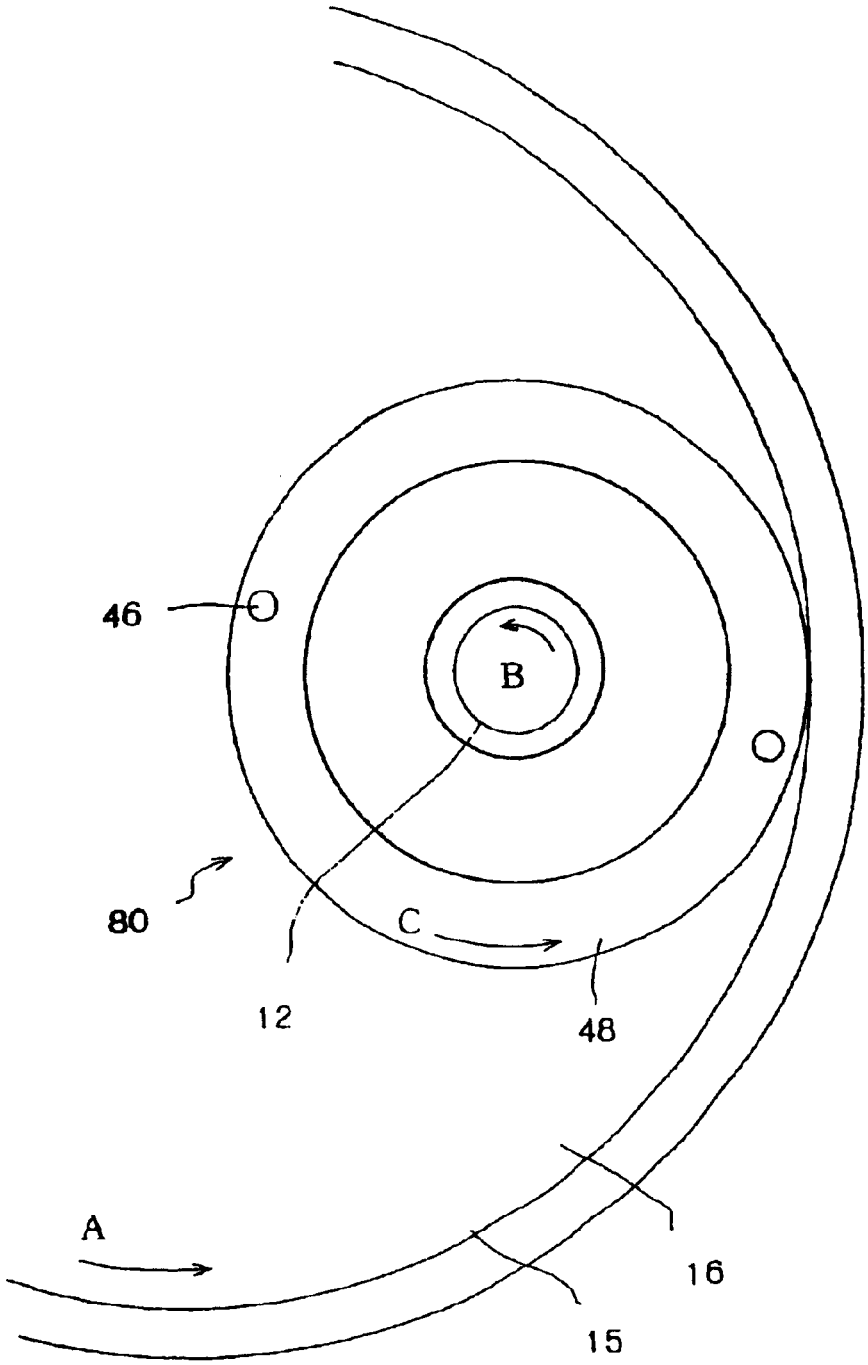
FIG. 10 is an explanation view showing a state, in which the head section shown in FIG. 7 is mounted on the polishing plate.

In the polishing machine shown in FIG. 7, the top ring 10 is coaxially inserted in the retainer ring 80 as shown in FIG. 10, and the wafer "W" is mounted onto the polishing plate 15 rotating in the direction "A" so as to polish the lower surface of the wafer "W". Note that the rollers 50 (see FIG. 1) for positioning the retainer ring are not required.

The top ring 10 is inserted in the cylindrical member 41 of the retainer ring 80 mounted on the polishing plate 14, so the top ring 10 is rotated in the direction "B" together with the rotary shaft 12.

On the other hand, the retainer ring 80 is mounted on the polishing plate 15 rotating in the direction "A", the retainer ring 80 is rotated in the direction "C", with the rotation of the polishing plate 15, without reference to the rotation of the top ring 10. The pressing face 44 of the pressing member 42 presses the polishing cloth 16 along the outer edge of the wafer "W" pressed onto the polishing cloth 16 by the top ring 10. With this action, level of the polishing cloth 16 pressed by the pressing face 44 of the pressing member 42 is made substantially equal to that of the polishing cloth 16 pressed by the lower surface of the wafer "W". Namely, the part of the polishing cloth 16 pressed by the pressing member 42 and the part of the polishing cloth 16 pressed by the wafer "W" can be substantially included in the same horizontal plane.

In FIG. 10, the top ring 10 and the retainer ring 80 are rotated in the same direction, but they are independently rotated so that their rotational speed can be easily respectively changed. By rotating the top ring 10 and the retainer ring 80 at different rotational speeds, the positional relationship between a prescribed position in the pressing face 44, which presses the polishing cloth 16, and a prescribed position in the wafer "W" held by the top ring 10, which presses the polishing cloth 16, is continuously changed. By changing the relationship, even if there are very fine projections in the pressing face 44 of the pressing member 42 of the retainer ring 80, negative influences caused by the fine projections can be dispersed and significantly reduced, so that accuracy of polishing the wafer "W" can be improved.

Figure 11:
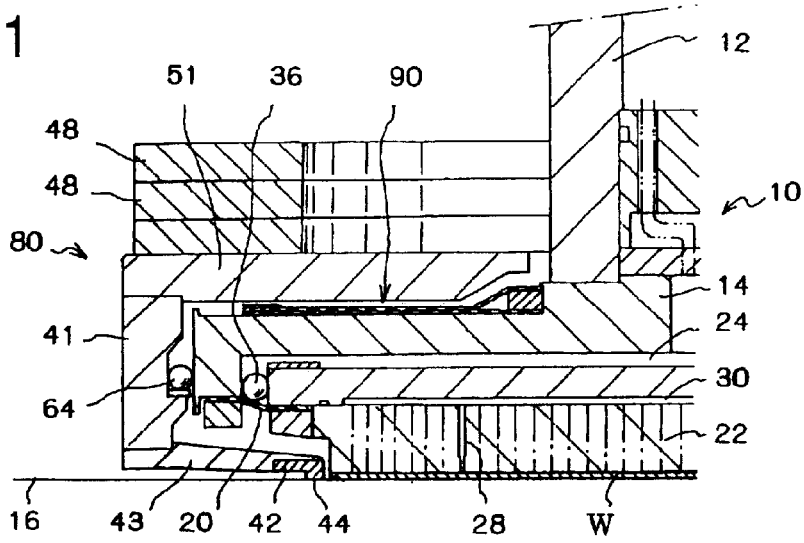
FIG. 11 a sectional view of the head section of other example of a polishing machine in accordance with the invention.
Figure 13:
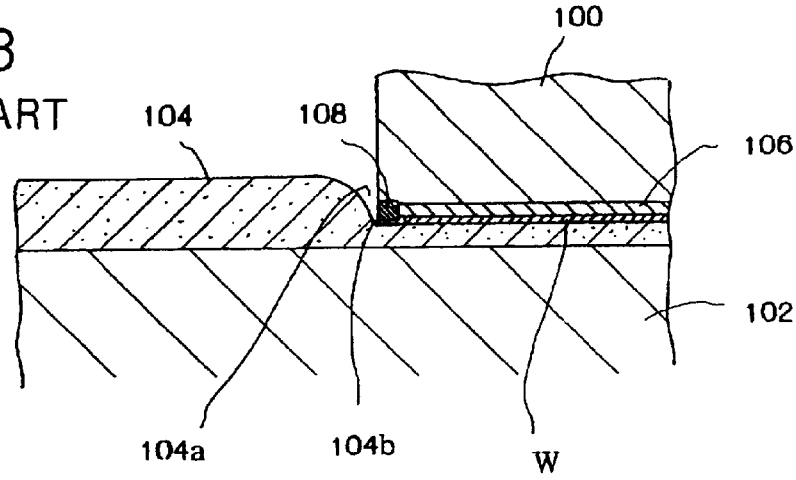
FIG.13 PRIOR ART
FIG. 13 is the sectional view of the head section of another conventional polishing machine.
Figure 14:
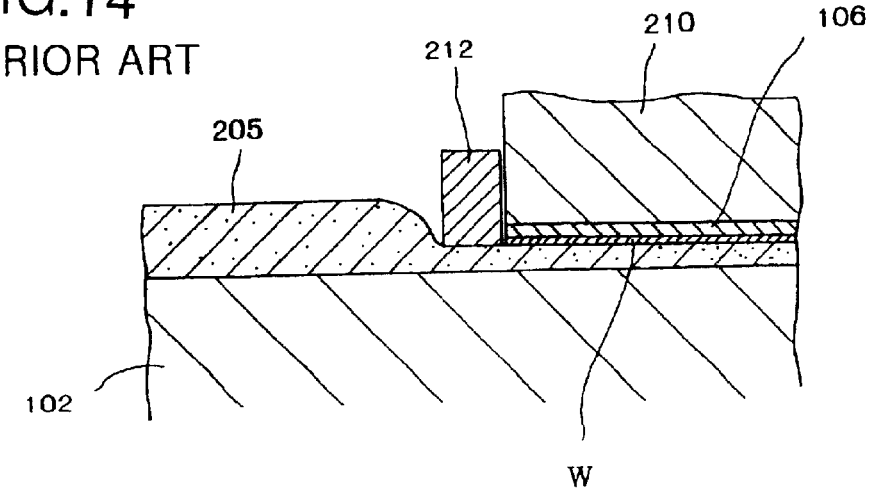
FIG.14 PRIOR ART
FIG. 14 is the explanation view showing the state of polishing the wafer by the conventional polishing machine shown in FIG. 12.
Figure 12:
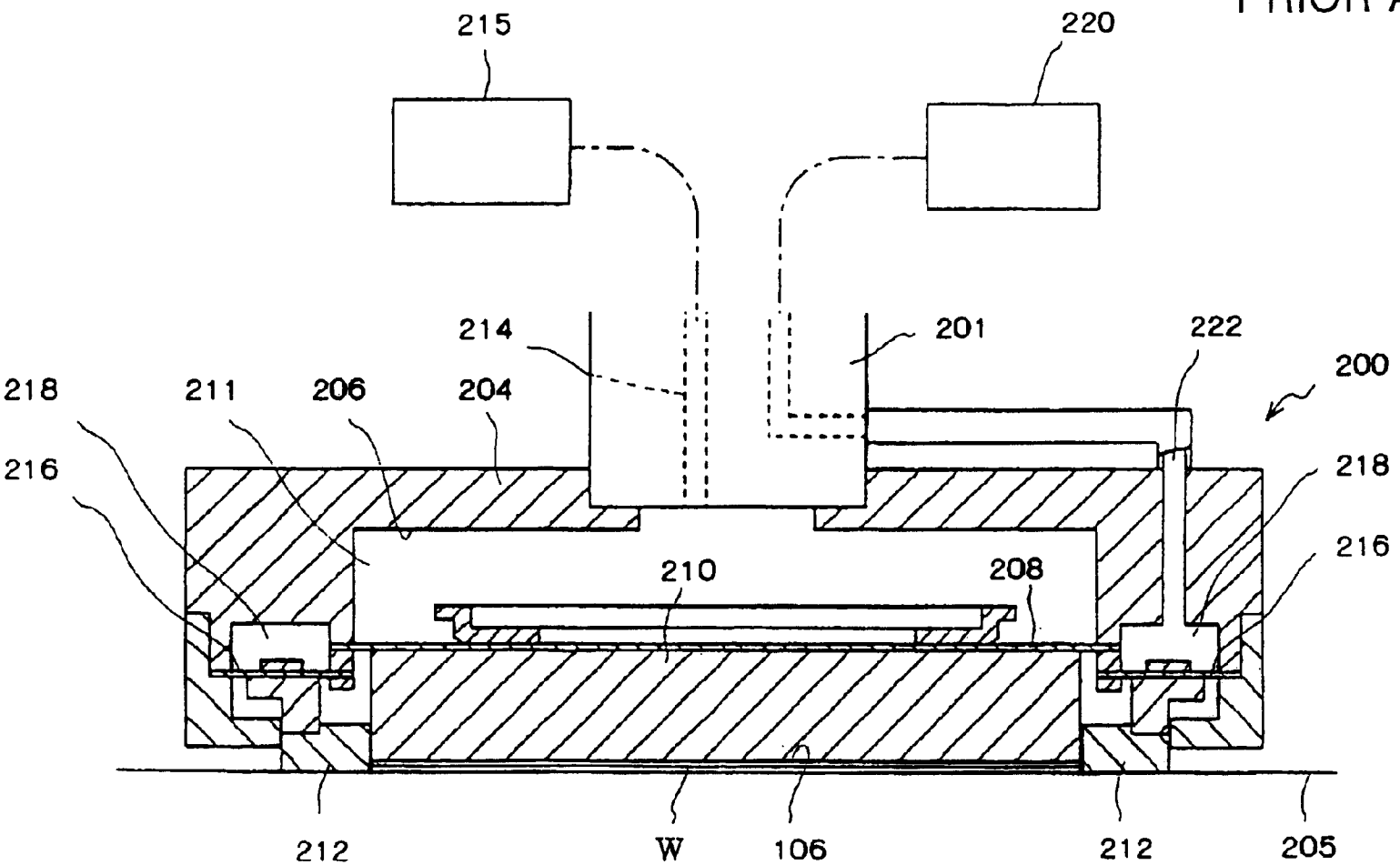
FIG.12 PRIOR ART
FIG. 12 is the explanation view of the conventional polishing machine.

In the polishing machine shown in FIGS. 7–10, the wafer "W" is indirectly held by the holding plate 22 of the top ring 10 with the carrier plate 23, but the wafer "W" may be directly held by the holding plate 22 of the top ring 10 as shown in FIG. 11. The wafer "W" is directly held by producing negative pressure in the communicating space 30, which is communicated to the through-holes 28 whose lower ends are opened in the holding face of the holding plate 22. The negative pressure can be produced by proper vacuum means, e.g., a vacuum pump. To release the wafer "W" from the holding plate 22, the vacuum means is stopped, then the negative pressure disappears so that the wafer "W" can be released.

Note that the wafer "W" may be held on the holding plate 22 by the negative pressure and the surface tension of water absorbed in the bucking member, e.g., unwoven cloth, adhered on the holding face of the holding plate 22. Namely, the holding plate 22 may directly or indirectly hold the wafer "W" on the holding face. When using the water surface tension, the wafer "W" may be held on the holding plate 22 by the water surface tension only while polishing the wafer "W".

Note that the structures of the top ring 10 and the retainer ring 80 shown in FIG. 11 are equal to those of the top ring and the retainer ring shown in FIG. 7, so the elements shown in FIG. 7 are assigned the same symbols and explanation will be omitted.

In the polishing machine shown in FIGS. 7–11, the positional relationship between the prescribed position in the pressing face 44, which presses the polishing cloth 16, and the prescribed position in the wafer "W", which presses the polishing cloth 16, is continuously changed as well as the polishing machine shown in FIGS. 1–6B. By changing the relationship, even if there are very fine projections in the pressing face 44 of the pressing member 42 of the retainer ring 80, adverse influences caused by the fine projections can be dispersed and significantly reduced, so that accuracy of polishing the wafer "W" can be improved.

Further, the retainer ring 80 is rotated by the rotation of the polishing plate 15, no rotating means, e.g., a motor, for rotating the retainer ring 80 is required, so that the structure of the polishing machine can be simplified. The balloon member 90, which acts as the moving means, is capable of moving the pressing member 42 of the retainer ring 80 close to and away from the polishing cloth 16 while the wafer "W" is pressed onto the polishing cloth 16 by the top ring 10. The pressing face 44 of the pressing member 42 of the retainer ring 80 can be pressed onto the polishing cloth 16 when pressing the polishing cloth 16 is required. Therefore, the span of life of the polishing cloth 16 can be extended, and the accuracy of polishing the wafer "W" can be improved.

The invention may be embodied in other specific forms without departing from the spirit or essential characteristics thereof. The present embodiments are therefore to be considered in all respects as illustrative and not restrictive, the scope of the invention being indicated by the appended claims rather than by he foregoing description and all changes which come within the meaning and range of equivalency of the claims are therefore intended to be embraced therein.

What is claimed is:

1. A polishing machine, comprising:

a rotary shaft;

a rotatable polishing plate on which polishing cloth is adhered;

a top ring connected to said rotary shaft, said top ring including a holding plate for holding and pressing a wafer onto a predetermined position of the polishing cloth of said polishing plate so to polish a surface of the wafer;

a retainer ring independently rotatable with respect to said top ring, said retainer ring being separated from said rotary shaft and not integrated with said rotary shaft, said retainer ring including a pressing member which encloses an outer edge of the wafer when the surface of the wafer held by the holding plate of said top ring is pressed onto the polishing cloth, said retainer ring pressing the polishing cloth so as to locate a surface of the polishing cloth pressed by the pressing member and another surface of the polishing cloth pressed by the wafer in a common plane, said top ring being freely insertable into and removable from said retainer ring without contacting said retainer ring; and a positioning member for correctly positioning said retainer ring on the polishing cloth of said polishing plate while said retainer ring is rotated about a rotationally axis of said top ring with rotation of said polishing plate, said positioning member contacting at least a part of an outer circumferential face of said retainer ring on the polishing cloth so as to correctly position said retainer ring.

2. The polishing machine according to claim 1, further comprising a weight provided to the pressing member of said retainer ring so as to locate a surface of the polishing cloth pressed by the pressing member and another surface of the polishing cloth pressed by the wafer in the common plate.

3. The polishing machine according to claim 1, wherein said positioning member is a roller contacting at least a part of an outer face of the pressing member of said retainer ring.

4. The polishing machine according to claim 1, wherein said top ring comprises:

a main body section having a concave part having an opening facing said polishing plate;

said holding plate holding the wafer and orienting the surface of the wafer toward said polishing plate;

an elastic sheet holding and biasing the holding plate toward an inner part of the concave part of said main body section, said elastic sheet being reinforced by a cloth-like reinforcing member;

a space being formed between said elastic sheet and an inner face of the concave part of said main body section, said space storing a pressure fluid to enable said holding plate to move toward said polishing plate against elasticity of said elastic sheet upon pressurization of said space by the pressure fluid; and a plurality of spherical bodies arranged between an outer circumferential face of said holding plate and an inner circumferential face of the concave part of said main body section, said spherical bodies point-contacting both circumferential faces, each of said spherical bodies contacting adjacent spherical bodies.

5. The polishing machine according to claim 1, wherein the holding plate of said top ring directly or indirectly holds the wafer.

6. The polishing machine according to claim 1, wherein said positioning member comprises at least one roller each contacting at least a part of an outer face of the pressing member of said retainer ring, said at least one roller being rotatable relative to said retainer ring.

7. The polishing machine according to claim 1, wherein said pressing member is annular, said retainer ring further comprising at least one pin extending upward from said pressing member and receivable of weights.

8. The polishing machine according to claim 1, wherein said pressing member is an annular disk, said top ring being movable to a position directly above said pressing member.

9. A polishing machine, comprising:

a rotary shaft;

a rotatable polishing plate on which polishing cloth is adhered;

a top ring connected to said rotary shaft, said top ring including a holding plate for holding and pressing a wafer onto a predetermined position of the polishing cloth of said polishing plate so as to polish a surface of the wafer;

a retainer ring including a pressing member which encloses an outer edge of the wafer when the surface of the wafer held by the holding plate of said top ring is pressed onto the polishing cloth, said retainer ring pressing the polishing cloth so as to locate a surface of the polishing cloth pressed by the pressing member and another surface of the polishing cloth pressed by the wafer in a common plane, said retainer ring further including a cylindrical member connected to the pressing member and defining a gap, and which is rotated on the polishing cloth of the polishing plate with rotation of the polishing plate, said top ring being freely insertable into and removable from said gap defined by said cylindrical member of said retainer ring; and a plurality of spherical bodies provided in the gap between an outer circumferential face of said top ring and an inner circumferential face of the cylindrical member, said spherical bodies point-contacting both circumferential faces to enable said top ring and said retainer ring to independently rotate relative to one another without said top ring and the cylindrical member contacting each other.

10. The polishing machine according to claim 9, further comprising means for engaging said top ring with said retainer ring when said top ring is moved and the surface of the wafer is separated from the polishing cloth.

11. The polishing machine according to claim 10, wherein said engaging means comprise hooks arranged in connection with said top ring and each having a projection, and recesses formed on said cylindrical member, said projections on said hooks being arranged to engage with said recesses on said cylindrical member.

12. The polishing machine according to claim 9, wherein said top ring comprises:

a main body section having a concave part having an opening facing said polishing plate;

said holding plate holding and orienting the surface of the wafer toward said polishing plate;

an elastic sheet holding and biasing the holding plate toward an inner part of the concave part of said main body section, said elastic sheet being reinforced by a cloth-like reinforcing member;

a space being formed between said elastic sheet and an inner face of the concave part of said main body section, said space storing a pressure fluid to enable said holding plate to move toward said polishing plate against elasticity of said elastic sheet upon pressurization of said space by the pressure fluid; and a plurality of spherical bodies arranged between an outer circumferential face of said holding plate and an inner circumferential face of the concave part of said main body section, said spherical bodies point-contacting both circumferential faces, with each of said spherical bodies contacting adjacent spherical bodies.

13. The polishing machine according to claim 9, wherein the holding plate of said top ring directly or indirectly holds the wafer.

14. The polishing machine according to claim 9, further comprising engaging means for enabling said top ring to be connected to said retainer ring when said top ring is moved and the surface of the wafer is separated from the polishing cloth and for enabling said top ring to be separated from said retainer ring when the surface of the wafer contacts the polishing cloth.

15. The polishing machine according to claim 9, further comprising annular weights arranged on said pressing member and around said cylindrical member.

16. A polishing machine, comprising:

a rotary shaft;

a rotatable polishing plate on which polishing cloth is adhered;

a top ring connected to said rotary shaft, said top ring including a holding plate for holding and pressing a wafer onto a predetermined position of the polishing cloth of said polishing plate so as to polish a surface of the wafer;

a retainer ring independently rotating with respect to said top ring, said retainer ring including a pressing member which encloses an outer edge of the wafer when the surface of the wafer held by the holding plate of said top ring is pressed onto the polishing cloth, said retainer ring pressing the polishing cloth so as to locate a surface of the polishing cloth pressed by the pressing member and another surface of the polishing cloth pressed by the wafer in a common plane;

means for moving the pressing member of said retainer ring toward and away from the polishing cloth while the surface of the wafer is pressed on the polishing cloth by said top ring; and a spacer arranged to maintain a gap between said top ring and said retainer ring to enable said top ring and said retainer ring to independently rotate relative to one another without said top ring and said retainer ring contacting each other.

17. The polishing machine according to claim 16, wherein said moving means comprises:

an extended section extended from said retainer ring to an upper face of said top ring;

a balloon member provided between said extended section and the upper face of said top ring; and fluid control means for supplying a fluid into said balloon member so as to expand said balloon member and upwardly move the extended section against pressing force of said retainer ring when the pressing member of said retainer ring is moved away from the polishing cloth, said fluid control means discharging the fluid from said balloon member so as to contract said balloon member and downwardly move the extended section with the pressing force of said retainer ring when the pressing member of said retainer ring is moved toward the polishing cloth.

18. The polishing machine according to claim 16, wherein said retainer ring includes a cylindrical section integrated with the pressing member and an extended section extended from the cylindrical member to an upper face of said top ring, a weight being provided to the pressing member of said retainer ring so as to locate a surface of the polishing cloth pressed by the pressing member and another surface of the polishing cloth pressed by the wafer in the common plane, and said top ring is inserted in the cylindrical member with a gap therebetween.

19. The polishing machine according to claim 16, wherein said spacer is a plurality of spherical bodies arranged between an outer circumferential face of said top ring inserted in said retainer ring and an inner circumferential face of said retainer ring, said spherical bodies point-contacting both circumferential faces.

20. The polishing machine according to claim 16, wherein said top ring comprises:

a main body section having a concave part having an opening facing said polishing plate;

said holding plate holding and orienting the surface of the wafer toward said polishing plate;

an elastic sheet holding and biasing the holding plate toward an inner part of the concave part of said main body section, said elastic sheet being reinforced by a cloth-like reinforcing member;

a space being formed between said elastic sheet and an inner face of the concave part of said main body section, said space storing a pressure fluid to enable said holding plate to move toward said polishing plate against elasticity of said elastic sheet upon pressurization of said space by the pressure fluid; and a plurality of spherical bodies arranged between an outer circumferential face of said holding plate and an inner circumferential face of the concave part of said main body section, said spherical bodies point-contacting both circumferential faces, each of said spherical bodies contacting adjacent spherical bodies.

21. The polishing machine according to claim 16, wherein the holding plate of said top ring directly or indirectly holds the wafer.

22. The polishing machine according to claim 16, wherein said moving means comprise an inflatable balloon member arranged between an upper face of said top ring and said retainer ring.

23. The polishing machine according to claim 22, wherein said moving means further comprise inflating means arranged partially in said rotary shaft for inflating said balloon member.

24. The polishing machine according to claim 16, wherein said retainer ring is separated from said rotary shaft and not integrated with said rotary shaft.

* * * * *